United States Patent [19]

Heerlein

[11] Patent Number: 4,515,511

[45] Date of Patent: May 7, 1985

[54] AXIAL FAN WITH BLADES THAT AUTOMATICALLY ADJUST TO THE DIRECTION OF ROTATION

[75] Inventor: Manfred Heerlein, Bad Neustadt, Fed. Rep. of Germany

[73] Assignee: Siemens Aktiengesellschaft, Berlin and Munich, Fed. Rep. of Germany

[21] Appl. No.: 543,209

[22] Filed: Oct. 19, 1983

[30] Foreign Application Priority Data

Dec. 31, 1982 [DE] Fed. Rep. of Germany ..... 3248760

[51] Int. Cl.[3] ..... F04D 29/36

[52] U.S. Cl. ..... 416/131; 416/140; 416/189; 416/241 A

[58] Field of Search ..... 416/131 R, 140 R, 132 A, 416/186 A, 189 R, 241 A

[56] References Cited

U.S. PATENT DOCUMENTS

| | | | |
|---|---|---|---|
| 1,882,961 | 10/1932 | Saunders | 416/140 R |
| 2,111,817 | 3/1938 | Sherman et al. | 416/140 R X |
| 2,257,976 | 10/1941 | Moorman | 416/131 R |
| 2,609,058 | 9/1952 | Place | 416/131 R X |
| 3,395,761 | 8/1968 | Holzer | 416/140 R X |
| 3,758,231 | 9/1973 | Barnstead | 416/93 X |
| 3,812,812 | 5/1974 | Hurwitz | 416/132 R X |
| 3,822,103 | 7/1974 | Hori et al. | 416/132 R |
| 3,915,591 | 10/1975 | Aiki et al. | 416/132 A |
| 4,396,351 | 8/1983 | Hayashi et al. | 416/189 R X |

FOREIGN PATENT DOCUMENTS

| | | | |
|---|---|---|---|
| 217155 | 3/1957 | Australia | 416/132 A |
| 92384 | 5/1896 | Fed. Rep. of Germany . | |
| 2736773 | 4/1978 | Fed. Rep. of Germany . | |
| 601647 | 7/1978 | Switzerland . | |
| 745084 | 2/1956 | United Kingdom | 416/131 R |
| 1579493 | 11/1977 | United Kingdom . | |
| 1544916 | 4/1979 | United Kingdom | 416/131 R |

*Primary Examiner*—Everette A. Powell, Jr.

*Attorney, Agent, or Firm*—F. W. Powers; J. L. James

[57] ABSTRACT

The invention relates to an axial fan with blades that automatically adjust to the direction of rotation. The fan blades are mounted with freedom to swivel on the fan wheel and are limited in their swiveling motion by stops which are provided on the fan wheel. In order to reduce the manufacturing cost of such an axial fan, spokes, to which the fan blades are fastened by means of film hinges are mounted on the fan wheel. The fan wheel is made from a single piece of plastic.

3 Claims, 3 Drawing Figures

AXIAL FAN WITH BLADES THAT AUTOMATICALLY ADJUST TO THE DIRECTION OF ROTATION

BACKGROUND OF THE INVENTION

The invention relates to an axial fan with blades that automatically adjust to the direction of rotation. The blades are mounted so they can swivel freely on the fan wheel with their swiveling action being limited by stops provided on the fan wheel.

A typical axial fan is disclosed by published German patent application DE-OS No. 2736773. In order to obtain the advantages of an axial fan for machines that can reverse their direction of rotation, the individual blades used in the fan are mounted with freedom to swivel, by means of a separate pivot pin. When the direction of rotation is reversed, the fan blades swivel automatically into the other final position, as a result of both their inertia and the air resistance so that even when the direction of rotation is reversed, the air continues to be moved in the same direction. The swivel arrangement, however, results in high manufacturing costs, beacause every fan blade must be individually mounted.

SUMMARY OF THE INVENTION

The object of the invention is to reduce manufacturing costs for an axial fan with swiveling blades, so that it can be used in machines that are mass produced.

In general, the invention features a fan wheel, constructed of a single piece of plastic, which is equipped with spokes between its hub and a guide ring to which the fan blades are fastened by means of film hinges. This allows the high assembly costs for mounting the fan blades with freedom to swivel to be eliminated.

The stress on the film hinges during operation is reduced by providing holding elements, both on the hub and on the guide ring, which constitute a form lock with the fan blade in their respective end positions. The forces that act on the fan blades are absorbed by these holding elements, and therefore, do not produce stresses on the film hinges.

Other features and advantages of the invention will be apparent from the following detailed description, and from the claims.

For a full understanding of the present invention, reference should now be made to the following detailed description and to the accompanying drawings.

BRIEF DESCRIPTION OF THE DRAWINGS

The invention is described below in detail, with reference to the following drawings.

DETAILED DESCRIPTION

Figure 1:
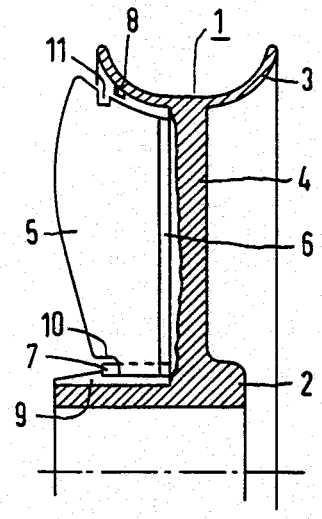
FIG. 1 is one-half of a cross-section of a fan wheel.

Referring to FIG. 1, fan wheel 1 is shown provided with spokes 4 which extend from hub 2 to guide ring 3. Fan blade 5 is fastened, with freedom to swivel, to each spoke 4 by means of a film hinge 6. The swivelling motion of the fan blade is limited by stops 9 which are molded on hub 2.

Figure 2:
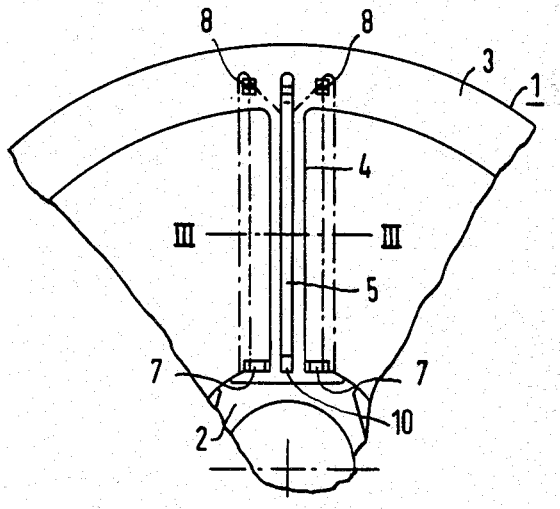
FIG. 2 is a partial view of a fan wheel.
Figure 3:
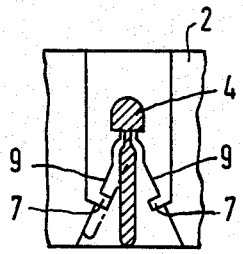
FIG. 3 is a cross-sectional view along line III—III in FIG. 2.

Projecting pins 7 are mounted on stops 9, and pins 8 pointing radially to hub 2 are mounted on guide ring 3. Pins 7 grip fan blades 5 from behind in notch 10, which is provided in the end nearest the hub. Pins 8 project, in the final position of the fan blades (shown by the broken lines in FIG. 2), into recess 11, which is formed in the guide ring end of fan blades 5. Pins 7 and 8 constitute a form lock with fan blades 5 in an axial direction, so that the axial forces acting on fan blade 5 are absorbed by pins 7 and 8 and accordingly not exerted on the film hinges.

Fan wheel 1 can be made from a single piece of plastic so that separate assembly of the swiveling fan blades is eliminated. Therefore, a reasonably priced axial fan can be made for machines with a reversible direction of rotation.

There has thus been shown and described a novel axial fan which fulfills all the objects and advantages sought. Many changes, modifications, variations and other uses and applications of the subject invention will, however, become apparent to those skilled in the art after considering the specification and the accompanying drawings which disclose embodiments thereof. All such changes, modifications, variations and other uses and applications which do not depart from the spirit and scope of the invention are deemed to be covered by the invention which is limited only by the claims which follow.

I claim:

1. In an axial fan of the type having a fan wheel having a hub, outwardly extending spokes aligned on said hub, a fan blade attached by a film hinge to each of said spokes with freedom to swivel whereby the freedom of said blades to swivel is limited by stops provided by the fan wheel, the improvement comprising:

said fan wheel being made of one piece of plastic material wherein said hub is centrally located as part of said one-piece fan wheel and a plurality of spokes are integrally connected to and extend outwardly from said hub and part of said one-piece fan wheel;

a guide ring circumferentially located to said spokes and said hub and integrally connected to said spokes;

two first locking elements are integrally connected to said hub and said stops located symmetrically on either side of each said spoke; and two second locking elements are integrally connected to said guide ring located symmetrically on either side of said spokes, said first and second locking elements engaging said fan blades in either of two positions limited by said stops providing a position lock with said blades in an axial direction.

2. The invention as set forth in claim 1, wherein:

said blades each have a notch on the edge opposite the hinge proximately located to said hub to provide engagement with said first locking elements; and said blades each have an opening on the edge opposite the hinge proximately located to said guide ring to provide engagement with said second locking elements.

3. An axial fan comprising:

a centrally located hub;

a plurality of spokes aligned on said hub and radially extending from said hub;

a plurality of fan blades;

a plurality of film hinges, integrally formed on said blades providing a connection between said blades and said spokes with freedom to swivel;

a guide ring circumferentially located and connected to said spokes;

a plurality of stops integral to said hub, two of which are located on either side of each of said spokes to limit the degree that said blades can swivel;

a plurality of first locking elements integral to said hub, two of which are symmetrically located on either side of said spokes to engage said blade;

a plurality of second locking elements integral to said guide ring, two of which are symmetrically located on either side of each of said spokes to engage said blades;

a notch furnished in the edge of each said blades opposite each of said film hinges proximately located to said hub to provide engagement with said first locking elements; and an opening furnished in the edge of each said blades opposite each of said film hinges proximately located to said guide ring to provide engagement with said second locking elements;

said axial fan having a one-piece construction whereby the film hinge freedom to swivel automatically changes and locks said blades in positions to provide a constant direction of axial flow of a medium regardless of the axial direction of said hub.

* * * * *